US008211611B2

(12) United States Patent
Ou et al.

(10) Patent No.: US 8,211,611 B2
(45) Date of Patent: Jul. 3, 2012

(54) TONER PROCESS INCLUDING MODIFYING RHEOLOGY

(75) Inventors: Zhaoyang Ou, Webster, NY (US); Zhen Lai, Webster, NY (US); Christopher D. Blair, Webster, NY (US); Chieh-Min Cheng, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 579 days.

(21) Appl. No.: 12/478,855

(22) Filed: Jun. 5, 2009

(65) Prior Publication Data

US 2010/0310983 A1 Dec. 9, 2010

(51) Int. Cl.
*G03G 9/08* (2006.01)

(52) U.S. Cl. ..... 430/137.1; 430/137.14; 430/137.19

(58) Field of Classification Search ..... 430/137.1, 430/137.14, 137.19

See application file for complete search history.

(56) References Cited

U.S. PATENT DOCUMENTS

| | | | | |
|---|---|---|---|---|
| 3,590,000 | A | | 6/1971 | Palermiti et al. |
| 3,800,588 | A | | 4/1974 | Larson et al. |
| 3,847,604 | A | | 11/1974 | Hagenbach et al. |
| 4,295,990 | A | | 10/1981 | Verbeek et al. |
| 4,935,326 | A | | 6/1990 | Creatura et al. |
| 4,937,166 | A | | 6/1990 | Creatura et al. |
| 5,236,629 | A | | 8/1993 | Mahabadi et al. |
| 5,290,654 | A | | 3/1994 | Sacripante et al. |
| 5,302,486 | A | | 4/1994 | Patel et al. |
| 5,330,874 | A | | 7/1994 | Mahabadi et al. |
| 5,344,738 | A | * | 9/1994 | Kmiecik-Lawrynowicz et al. ..... 430/137.14 |
| 5,346,797 | A | | 9/1994 | Kmiecik-Lawrynowicz et al. |
| 5,364,729 | A | | 11/1994 | Kmiecik-Lawrynowicz et al. |
| 5,403,693 | A | | 4/1995 | Patel et al. |
| 5,418,108 | A | | 5/1995 | Kmiecik-Lawrynowicz et al. |
| 5,501,935 | A | | 3/1996 | Patel et al. |
| 5,527,658 | A | | 6/1996 | Hopper et al. |
| 5,585,215 | A | | 12/1996 | Ong et al. |
| 5,650,255 | A | | 7/1997 | Ng et al. |
| 5,650,256 | A | | 7/1997 | Veregin et al. |
| 5,853,943 | A | | 12/1998 | Cheng et al. |
| 6,063,827 | A | | 5/2000 | Sacripante et al. |
| 6,214,507 | B1 | | 4/2001 | Sokol et al. |
| 6,593,049 | B1 | | 7/2003 | Veregin et al. |
| 6,756,176 | B2 | | 6/2004 | Stegamat et al. |
| 6,830,860 | B2 | | 12/2004 | Sacripante et al. |
| 7,452,646 | B2 | | 11/2008 | Hu et al. |
| 2006/0222991 | A1 | | 10/2006 | Sacripante et al. |
| 2008/0153025 | A1 | | 6/2008 | Lai et al. |
| 2008/0193869 | A1 | * | 8/2008 | Vanbesien et al. ..... 430/108.4 |

* cited by examiner

*Primary Examiner* — Hoa V Le
(74) *Attorney, Agent, or Firm* — Judith L. Byorick

(57) ABSTRACT

A process for making particles is provided. In embodiments, a suitable process includes adding a rheology modifier to an emulsion utilized to form toner particles. The rheology modifier permits the use of a higher solid content in the emulsion, with a resulting higher yield of toner particles, without requiring the use of powerful mixing equipment.

20 Claims, No Drawings

TONER PROCESS INCLUDING MODIFYING RHEOLOGY

BACKGROUND

The present disclosure relates to processes for producing toners suitable for electrostatographic apparatuses.

Numerous processes are within the purview of those skilled in the art for the preparation of toners. Emulsion aggregation (EA) is one such method. These toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

EA toner processes include coagulating a combination of emulsions, i.e., emulsions including a latex, wax, pigment, and the like, with a flocculent such as polyaluminum chloride and/or aluminum sulfate, to generate a slurry of primary aggregates which then undergoes a controlled aggregation process. The solid content of this primary slurry dictates the overall throughput of the EA toner process. The solids content of the primary slurry is conventionally between about 11% and about 14%. While an even higher solids content may be desirable, it may be difficult to achieve due to high viscosity of the emulsions and poor mixing, which may lead to the formation of unacceptable primary aggregates (high coarse particle content).

Improved methods for producing toners, which reduce the number of stages and materials, remain desirable. Such processes may reduce production costs for such toners and may be environmentally friendly.

SUMMARY

The present disclosure provides processes for making toner particles. In embodiments, a process of the present disclosure includes contacting at least one resin with at least one surfactant to form an emulsion; contacting the emulsion with an optional wax, an optional colorant, and at least one rheology modifier including a polyol of the formula $H(HCHO)_{n+1}H$, where n is from about 1 to about 20, to form a primary slurry; aggregating the at least one amorphous polyester resin in combination with at least one crystalline polyester resin with an aggregating agent to form aggregated particles; coalescing the aggregated particles to form toner particles; and recovering the toner particles, wherein the emulsion has a solids content of from about 5% to about 35% by weight.

In other embodiments a process of the present disclosure includes contacting at least one amorphous polyester resin in combination with at least one crystalline polyester resin and at least one surfactant to form an emulsion; contacting the emulsion with an optional wax, an optional colorant, and at least one rheology modifier including a polyol of the formula $H(HCHO)_{n+1}H$, where n is from about 1 to about 20, to form a primary slurry; aggregating the at least one amorphous polyester resin in combination with at least one crystalline polyester resin with an aggregating agent to form aggregated particles; coalescing the aggregated particles to form toner particles; and recovering the toner particles, wherein the emulsion has a solids content of from about 5% to about 35% by weight.

In yet other embodiments, a process of the present disclosure includes contacting at least one amorphous polyester resin in combination with at least one crystalline polyester resin and at least one surfactant to form an emulsion; contacting the emulsion with an optional wax, an optional colorant, and at least one rheology modifier such as ethylene glycol, propylene glycol, diethylene glycol, triethylene glycol, dipropylene glycol, polyethylene glycol, neopentylene glycol, polypropylene glycol, glycerol, erythritol, threitol, arabitol, xylitol, ribitol, d-mannitol, sorbitol, galactitol, iditol, isomalt, maltitol, lactitol, and combinations thereof, in an amount of from about 0.01 pph to about 1 pph, to form a primary slurry having a viscosity of from about 100 cps to about 5000 cps; aggregating the at least one amorphous polyester resin in combination with at least one crystalline polyester resin with an aggregating agent to form aggregated particles; coalescing the aggregated particles to form toner particles; and recovering the toner particles, wherein the emulsion has a solids content of from about 5% to about 35% by weight.

DETAILED DESCRIPTION

The present disclosure provides processes for producing toner particles. In embodiments, a process of the present disclosure includes the use of a rheology modifier to enable high solids loading of emulsions utilized to form a toner and therefore high throughput and less waste water generation in the EA toner process. The EA process of the present disclosure utilizing the rheology modifier is thus environmentally friendly.

As used herein, in embodiments, for example, a rheology modifier, and/or a rheology thinner, may be utilized interchangeably and may include, for example, any material capable of adjusting the viscosity, in embodiments lowering the viscosity, of an emulsion utilized in forming toners.

Resins

Any toner resin may be utilized in the processes of the present disclosure. Such resins, in turn, may be made of any suitable monomer or monomers via any suitable polymerization method. In embodiments, the resin may be prepared by a method other than emulsion polymerization. In further embodiments, the resin may be prepared by condensation polymerization.

In embodiments, the resin may be a polyester, polyimide, polyolefin, polyamide, polycarbonate, epoxy resin, and/or copolymers thereof. In embodiments, the resin may be an amorphous resin, a crystalline resin, and/or a mixture of crystalline and amorphous resins. The crystalline resin may be present in the mixture of crystalline and amorphous resins, for example, in an amount of from 0 to about 50 percent by weight of the total toner resin, in embodiments from 5 to about 35 percent by weight of the toner resin. The amorphous resin may be present in the mixture, for example, in an amount of from about 50 to about 100 percent by weight of the total toner resin, in embodiments from 95 to about 65 percent by weight of the toner resin. In embodiments, the resin may be a polyester crystalline and/or a polyester amorphous resin.

In embodiments, the polymer utilized to form the resin may be a polyester resin, including the resins described in U.S. Pat. Nos. 6,593,049 and 6,756,176, the disclosures of each of which are hereby incorporated by reference in their entirety.

Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), and copoly (ethylene-fumarate)-copoly(ethylene-dodecanoate). The crystalline resin may be present, for example, in an amount of from about 5 to about 50 percent by weight of the toner components, in embodiments from about 10 to about 35 percent by weight of the toner components.

The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 3 to about 4.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

In embodiments, polycondensation catalysts may be used in forming the polyesters. Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly (propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfoisophthalate), copoly(propylene-butylene-terephthalate)-copoly(propylene-butylene-5-sulfo-isophthalate), and copoly(propoxylated bisphenol-A-fumarate)-copoly(propoxylated bisphenol A-5-sulfo-isophthalate).

In embodiments, an unsaturated, amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly (butyloxylated bisphenol co-fumarate), poly(co-propoxylated bisphenol co-ethoxylated bisphenol co-fumarate), poly (1,2-propylene fumarate), poly(propoxylated bisphenol co-maleate), poly(ethoxylated bisphenol co-maleate), poly (butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

The amorphous resin can possess various glass transition temperatures (Tg) of, for example, from about 40° C. to about 100° C., in embodiments from about 50° C. to about 70° C. The crystalline resin may have a number average molecular weight ($M_n$), for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography (GPC) using polystyrene standards. The molecular weight distribution ($M_w/M_n$) of the crystalline resin may be, for example, from about 2 to about 6, in embodiments from about 3 to about 4.

In embodiments, a suitable amorphous polyester resin may be a poly(propoxylated bisphenol A co-fumarate) resin having the following formula (I):

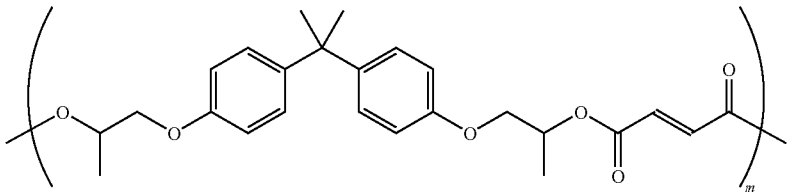

(I)

wherein m may be from about 5 to about 1000, in embodiments from about 10 to about 500, in other embodiments from about 15 to about 200. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a toner resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C. and the like.

Suitable crystalline resins which may be utilized, optionally in combination with an amorphous resin as descried above, include those disclosed in U.S. Patent Application Publication No. 2006/0222991, the disclosure of which is hereby incorporated by reference in its entirety. In embodiments, a suitable crystalline resin may include a resin formed of ethylene glycol and a mixture of dodecanedioic acid and fumaric acid co-monomers with the following formula:

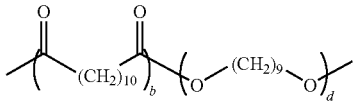

(II)

wherein b is from about 5 to about 2000 and d is from about 5 to about 2000.

For example, in embodiments, a poly(propoxylated bisphenol A co-fumarate) resin of formula I as described above may be combined with a crystalline resin of formula II to form a resin suitable for forming a toner.

Examples of other suitable toner resins or polymers which may be utilized include those based upon styrenes, acrylates, methacrylates, butadienes, isoprenes, acrylic acids, methacrylic acids, acrylonitriles, and combinations thereof. Exemplary additional resins or polymers include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and combinations thereof. The polymer may be block, random, or alternating copolymers.

In embodiments, the resins may include polyester resins having a glass transition temperature of from about 30° C. to about 80° C., in embodiments from about 35° C. to about 70° C. In further embodiments, the resins utilized in the toner may have a melt viscosity of from about 10 to about 1,000,000 Pa*S at about 130° C., in embodiments from about 20 to about 100,000 Pa*S.

One, two, or more toner resins may be used. In embodiments where two or more toner resins are used, the toner resins may be in any suitable ratio (e.g., weight ratio) such as for instance about 10% (first resin)/90% (second resin) to about 90% (first resin)/10% (second resin).

In embodiments, the resin may be formed by emulsion aggregation methods. Utilizing such methods, the resin may be present in a resin emulsion, which may then be combined with other components and additives to form a toner of the present disclosure.

The polymer resin may be present in an amount of from about 65 to about 95 percent by weight, in embodiments from about 75 to about 85 percent by weight of the toner particles (that is, toner particles exclusive of external additives) on a solids basis. Where the resin is a combination of a crystalline resin and an amorphous resin, the ratio of crystalline resin to amorphous resin can be in embodiments from about 1:99 to about 30:70, in embodiments from about 5:95 to about 25:75, in some embodiments from about 5:95 to about 15:95.

Toner

The resin described above may be utilized to form toner compositions. Such toner compositions may include optional colorants, waxes, and other additives. Toners may be formed utilizing any method within the purview of those skilled in the art.

Surfactants

In embodiments, resins, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and optional colorant in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner particle shape and morphology.

In embodiments, toner compositions may be prepared by emulsion-aggregation processes, such as a process that includes aggregating a mixture of an optional colorant, an optional wax and any other desired or required additives, and emulsions including the resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 4 to about 5. Additionally, in embodiments, the mixture may be homogenized. If the mixture is homogenized, homogenization may be accomplished by mixing at about 600 to about 4,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture. This provides a sufficient amount of agent for aggregation.

In order to control aggregation and subsequent coalescence of the particles, in embodiments the aggregating agent may be metered into the mixture over time. For example, the agent may be metered into the mixture over a period of from about 5 to about 240 minutes, in embodiments from about 30 to about 200 minutes. The addition of the agent may also be done while the mixture is maintained under stirred conditions, in embodiments from about 50 rpm to about 1,000 rpm, in other embodiments from about 100 rpm to about 500 rpm, and at a temperature that is below the glass transition temperature of the resin as discussed above, in embodiments from about 30° C. to about 90° C., in embodiments from about 35° C. to about 70° C.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 30° C. to about 99° C., and holding the mixture at this temperature for a time from about 0.5 hours to about 10 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Rheology Modifier

Emulsions used in an EA toner process, for example, multiple emulsions including resins, colorants, waxes, combinations thereof, and the like, may include nano-sized particles with surface charge stabilization imparted by adsorbed surfactants. These particles may thus repel each other and emulsions formed with these materials may have a low viscosity, even at a very high solids content, for example, from about 40% to about 60%. As described above, during EA toner manufacturing, the surface charge of the nanoparticles may be neutralized by the addition of an aggregating agent, in embodiments polyaluminum chloride and/or aluminum sulfate. The resulting neutralized nanoparticles may thus have strong inter-particle attraction with each other. Accordingly, aggregates of nanoparticles begin forming and growing in size, which may be referred to as primary aggregates, having a diameter of less than about 3 μm.

The formation of primary aggregates may result in a rapid rise of slurry viscosity. For example, in an EA toner having about 11.5% solids content in the primary slurry, the viscosity may be about 50 cps, resembling a finger paint paste. A dynamic transient network of particles of various sizes (from nanoparticles to primary aggregates) may form, thereby contributing to the increased viscosity of the slurry. Mechanical shearing forces may be utilized to break down such network structures, providing flow and mixing. Alternatively, chemical species can be introduced to (1) shield the attractive interaction among particles; and (2) provide molecular-level lubrication among particles as they are sheared and slide past each other.

In accordance with the present disclosure, a rheology modifier may be added to an emulsion, in embodiments a mixture of emulsions utilized to form toner particles, before the emulsions are coagulated with an aggregating agent to form a slurry of primary particles ("primary slurry"). Suitable rheology modifiers include, for example, polyols, sometimes referred to herein as polyhydric alcohols, having the general formula $H(HCHO)_{n+1}H$, where n is from about 1 to about 20, in embodiments from about 2 to about 10. Exemplary polyols which may be used as a rheology modifier include, but are not limited to, ethylene glycol, propylene glycol, diethylene glycol, triethylene glycol, dipropylene glycol, polyethylene glycol, neopentylene glycol, polypropylene glycol, glycerol, erythritol, threitol, arabitol, xylitol, ribitol, d-mannitol, sorbitol, galactitol, iditol, isomalt, maltitol, lactitol, combinations thereof, and the like.

Such rheology modifiers may enable high solid loadings in the primary slurry, while maintaining good flow and desirable size distribution of primary aggregates. In accordance with the present disclosure, the main criteria for choosing a rheology modifier include: (1) it should possess excellent water solubility; (2) it should not interfere with aggregation process; (3) it should not negatively affect toner particle performance; and (4) it should be environmentally benign with respect to waste water treatment.

In some embodiments, dipropylene glycol may be utilized as the rheology modifier to reduce slurry viscosity and enable high solids load/high throughput in an EA toner. Dipropylene glycol is a water-soluble and colorless liquid with low-odor and low volatility. It is non-toxic and is generally recognized as safe for use in food, cosmetics, and medicines by FDA. Dipropylene glycol has the following structure:

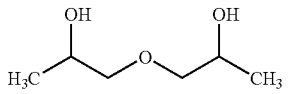

(III)

The rheology modifier, in embodiments dipropylene glycol, may be added to polymer emulsions at dose levels generally less than about 1 pph, in embodiments from about 0.01 pph to about 1 pph, in embodiments from about 0.05 pph to about 0.6 pph. In accordance with the present disclosure, a rheology modifier, such as dipropylene glycol, is non-ionic and will not interfere with an aluminum-based aggregation process as described above. It can, however, significantly reduce the viscosity of the primary slurry. Thus, in accordance with the present disclosure, one may utilize emulsions with a higher solids loading in the EA toner process.

Utilizing a rheology modifier as described herein, for forming toner particles, the solids content of the emulsion may thus be from about 5% to about 35%, in embodiments from about 10% to about 25%, in other embodiments about 15.5% of the emulsion.

The viscosity of the primary slurry may be strongly reduced in the presence of the rheology modifier, such as dipropylene glycol. For example, the viscosity of the primary slurry may be from about 100 cps to about 5000 cps, in embodiments from about 1000 cps to about 4000 cps.

Adequate mixing of the primary slurry, having a high solids content, may thus be obtained without having to resort to powerful mixing equipment. Also, due to its high water solubility, the rheology modifier, in embodiments dipropylene glycol, may be present mostly in the water phase of the slurry and thus does not remain in washed and dried toners, thereby minimizing its potential effect on toner properties.

The present disclosure provides a simple yet efficient approach to achieving a high throughput EA toner process. An increase in the solids content of the emulsions, for example just 1%, could result in an extra 200 kilograms of particles (for a black toner) per batch. This could, in embodiments, represent an additional 200,000 kilograms of toner particles obtained, without the requirement of any additional investment of capital.

Particles

Once the desired final size of the toner particles is achieved, the pH of the mixture may be adjusted with a base to a value of from about 3 to about 10, and in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

Shell Resin

In embodiments, after aggregation, but prior to coalescence, a shell may be applied to the aggregated particles.

Resins which may be utilized to form the shell include, but are not limited to, the amorphous resins described above for use in the core. In embodiments, an amorphous resin which may be used to form a shell in accordance with the present disclosure may include an amorphous polyester of formula I above.

In some embodiments, the amorphous resin utilized to form the shell may be crosslinked. For example, crosslinking may be achieved by combining an amorphous resin with a crosslinker, sometimes referred to herein, in embodiments, as an initiator. Examples of suitable crosslinkers include, but are not limited to, for example free radical or thermal initiators such as organic peroxides and azo compounds described above as suitable for forming a gel in the core. Examples of suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl2,5-di(2-ethyl hexanoyl peroxy)hexane, t-amyl peroxy2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl2,5-di(benzoyl peroxy) hexane, oo-t-butyl o-(2-ethyl hexyl)mono peroxy carbonate, and oo-t-amyl o-(2-ethyl hexyl)mono peroxy carbonate, alkyl peroxides such as, for example, dicumyl peroxide, 2,5-dimethyl2,5-di(t-butyl peroxy)hexane, t-butyl cumyl peroxide, α-α-bis(t-butyl peroxy)diisopropyl benzene, di-t-butyl peroxide and 2,5-dimethyl2,5di(t-butyl peroxy)hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di(t-butyl peroxy)valerate, 1,1-di(t-butyl peroxy)3,3,5-trimethyl cyclohexane, 1,1-di(t-butyl peroxy)cyclohexane, 1,1-di(t-amyl peroxy)cyclohexane, 2,2-di(t-butyl peroxy)butane, ethyl 3,3-di(t-butyl peroxy)butyrate and ethyl 3,3-di(t-amyl peroxy)butyrate, and combinations thereof. Examples of suitable azo compounds include 2,2,'-azobis(2,4-dimethylpentane nitrile), azobis-isobutyronitrile, 2,2'-azobis(isobutyronitrile), 2,2'-azobis(2,4-dimethyl valeronitrile), 2,2'-azobis(methyl butyronitrile), 1,1'-azobis(cyano cyclohexane), other similar known compounds, and combinations thereof.

The crosslinker and amorphous resin may be combined for a sufficient time and at a sufficient temperature to form the crosslinked polyester gel. In embodiments, the crosslinker and amorphous resin may be heated to a temperature of from about 25° C. to about 99° C., in embodiments from about 30° C. to about 95° C., for a period of time of from about 1 minute to about 10 hours, in embodiments from about 5 minutes to about 5 hours, to form a crosslinked polyester resin or polyester gel suitable for use as a shell.

Where utilized, the crosslinker may be present in an amount of from about 0.001% by weight to about 5% by weight of the resin, in embodiments from about 0.01% by weight to about 1% by weight of the resin. The amount of CCA may be reduced in the presence of crosslinker or initiator.

A single polyester resin may be utilized as the shell or, in embodiments, a first polyester resin may be combined with other resins to form a shell. Multiple resins may be utilized in any suitable amounts. In embodiments, a first amorphous polyester resin, for example an amorphous resin of formula I above, may be present in an amount of from about 20 percent by weight to about 100 percent by weight of the total shell resin, in embodiments from about 30 percent by weight to about 90 percent by weight of the total shell resin. Thus, in embodiments, a second resin may be present in the shell resin in an amount of from about 0 percent by weight to about 80 percent by weight of the total shell resin, in embodiments from about 10 percent by weight to about 70 percent by weight of the shell resin.

Coalescence

Following aggregation to the desired particle size and application of an optional shell resin described above, the particles may then be coalesced to the desired final shape, the coalescence being achieved by, for example, heating the mixture to a suitable temperature. This temperature may, in embodiments, be from about 40° C. to about 99° C., in embodiments from about 50° C. to about 95° C. Higher or lower temperatures may be used, it being understood that the temperature is a function of the resins used.

Coalescence may also be carried out with stirring, for example at a speed of from about 50 rpm to about 1,000 rpm, in embodiments from about 100 rpm to about 600 rpm. Coalescence may be accomplished over a period of from about 1 minute to about 24 hours, in embodiments from about 5 minutes to about 10 hours.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

In accordance with the present disclosure, most of the rheology modifier, in embodiments dipropylene glycol, may be removed during the washing process due to its strong affinity to water. The rheology modifier may be selected so that is poses no additional environmental handling requirement since it generally may be non-toxic and decomposes biologically in waste water treatment process.

Additives

In embodiments, the toner particles may also contain other optional additives, as desired or required. For example, there can be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner. Suitable additives include those disclosed in U.S. Pat. Nos. 3,590,000, 3,800,588, 6,214,507, and 7,452,646 the disclosures of each of which are hereby incorporated by reference in their entirety. Again, these additives may be applied simultaneously with the shell resin described above or after application of the shell resin.

In embodiments, toners of the present disclosure may be utilized as ultra low melt (ULM) toners. In embodiments, the dry toner particles having a shell of the present disclosure may, exclusive of external surface additives, have the following characteristics:

(1) Volume average diameter (also referred to as "volume average particle diameter") of from about 3 to about 25 μm, in embodiments from about 4 to about 15 μm, in other embodiments from about 5 to about 12 μm.

(2) Number Average Geometric Size Distribution (GSDn) and/or Volume Average Geometric Size Distribution (GSDv) of from about 1.05 to about 1.55, in embodiments from about 1.1 to about 1.4.

(3) Circularity of from about 0.93 to about 1, in embodiments from about 0.95 to about 0.99 (measured with, for example, a Sysmex FPIA 2100 analyzer).

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may possess A zone charging of from about −3 μC/g to about −60 μC/g, in embodiments from about −4 μC/g to about −50 μC/g, a parent toner charge per mass ratio (Q/M) of from about −3 μC/g to about −60 μC/g, in embodiments from about −4 μC/g to about −50 μC/g, and a final triboelectric charge of from −4 μC/g to about −50 μC/g, in embodiments from about −5 μC/g to about −40 μC/g.

Developers

The toner particles thus obtained may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight, of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrostatographic or xerographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with a xerographic device including a charging component, an imaging component, a photoconductive component, a developing component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

An emulsion aggregation toner was prepared as follows. Briefly, about 8.221 kilograms of a linear amorphous resin A in an emulsion (about 35 weight % resin) and 8.221 kilograms of a linear amorphous resin B in an emulsion (about 35 weight % resin) were added to a 20-gallon reactor. The linear amorphous resins A and B were of the following formula:

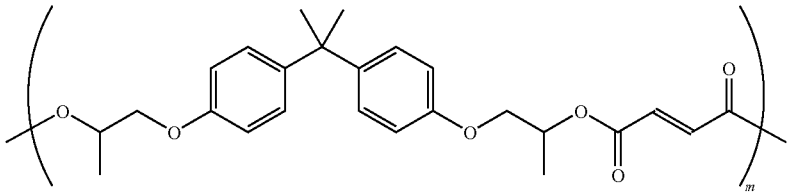

(I)

wherein m for linear amorphous resin A was about 50, and m for linear amorphous resin B was about 140; these resins were produced following the procedures described in U.S. Pat. No. 6,063,827, the disclosure of which is hereby incorporated by reference in its entirety. About 2.4 kilograms of a crystalline polyester resin composed of dodecanedioic acid and 1,9-Nonanediol with the following formula:

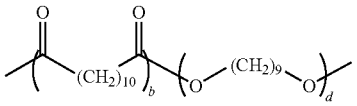

(II)

wherein b was from about 5 to about 2000 and d was from about 5 to about 2000, in an emulsion (about 30 weight % resin), synthesized following the procedures described in U.S. Patent Application Publication No. 2006/0222991, the disclosure of which is hereby incorporated by reference in its entirety, with about 3.79 kilograms of a cyan pigment, Pigment Blue 15:3 (about 17.4 wt %), about 2.95 kilograms of a paraffin wax (about 30.58 wt %), and about 28.39 kilograms of deionized water, were added to the reactor. The pH of the mixture was adjusted to about 4.2 by adding about 2.04 kilogram of nitric acid (about 0.3M). About 2.7 kilograms of $Al_2(SO_4)_3$ (about 1 weight %) was added as a flocculent under homogenization at a speed of from about 2000 rpm to about 4000 rpm.

About 0.06 pph of dipropylene glycol was added to the emulsion as a rheology modifier. An untreated emulsion was utilized as a control to form toner particles without the rheology modifier.

For both the exemplified process and the control, the mixture was subsequently heated to about 48° C. for aggregation while mixing at a speed of about 350 rpm.

When the particle size reached a certain value, for example about 5 μm, a mixture of about 4.46 kilogram of linear amorphous resin A in an emulsion (about 35 weight % resin) and about 4.45 kilogram of linear amorphous resin B in an emulsion (about 35 weight % resin) were added to the reactor. Before addition, the pH of the mixture was adjusted to about 3-3.5 by adding about 0.93 kilogram of nitric acid (about 0.3M). The particle size was monitored with a Coulter Counter and the Geometric Size Distribution ("GSD") was determined.

Table 1 below includes a summary of the toners prepared in accordance with the present disclosure (circ.=circularity; AC=aggregation/coalescence)

TABLE 1

| | Solid content in primary slurry (%) | Yield stress (Tau0, Pa) | D50v (μm) | GSDn | GSDv | Circ. | Waste water in AC (kg/100 kg product) | Through put (kg) |
|---|---|---|---|---|---|---|---|---|
| Control | 11.5 | 18.5 | 5.85 | 1.28 | 1.20 | 0.963 | 614 | 100 |
| Example 1 | 15.5 | 24.1 | 5.80 | 1.22 | 1.20 | 0.962 | 455 | 128 |

As can be seen from Table 1, similar particles were made where the rheology modifier was utilized, while at the same time, a 28% increase in throughput was observed and the associated waste water was reduced by about 30%.

Particles made from the polyester dispersion with the rheology modifier as well as the control were further converted to toner particles with additives: Fumed silica AEROSIL® RY50L (1.29%), Fumed silica AEROSIL® RX50 (0.86%), silica X24 (1.73%), isobutyltrimethoxysilane (STT100H) (0.88%), Cerium Oxide (E10) (0.275%), Zinc Stearate (0.18%), and PMMA fines (MP116CF) (0.50%) and evaluated. Properties of the toners were analyzed, with the results listed in Table 2 below.

TABLE 2

| | C Zone (10° C./15% RH) | | A Zone (28° C./85% RH) | |
|---|---|---|---|---|
| | Targets | | | |
| Toner ID | (4 mm-11 mm) q/d (mm) | q/m (μC/g) | (4 mm-11 mm) q/d (mm) | q/m (Mc/g) |
| Control | 11.5 | 48 | 8.7 | 36 |
| Example 1 | 11.5 | 46 | 8.6 | 34 |

As can be seen from Table 2, toner particles made with dispersions possessing the rheology modifier of the present disclosure had properties that were comparable to the control.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A method comprising:

contacting at least one resin with at least one surfactant to form an emulsion;

contacting the emulsion with an optional wax, an optional colorant, and at least one rheology modifier comprising a polyol, to form a primary slurry;

aggregating the at least one resin in the primary slurry with an aggregating agent to form aggregated particles;

coalescing the aggregated particles to form toner particles; and recovering the toner particles, wherein the emulsion has a solids content of from about 5% to about 35% by weight.

2. The method of claim 1, wherein the at least one resin comprises styrenes, acrylates, methacrylates, butadienes, isoprenes, acrylic, acids, methacrylic acids, acrylonitriles, and combinations thereof.

3. The method of claim 1, wherein the at least one resin comprises at least one amorphous resin optionally in combination with at least one crystalline resin.

4. The method of claim 1, wherein the at least one resin comprises an amorphous polyester resin of the formula:

(I)

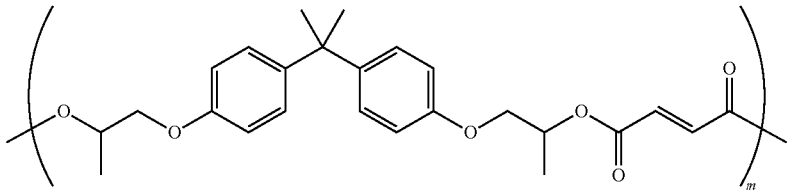

wherein m is from about 5 to about 1000, in combination with a crystalline polyester resin of the formula:

(II)

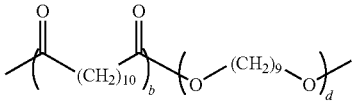

wherein b is from about 5 to about 2000 and d is from about 5 to about 2000.

5. The method of claim 1, wherein the at least one surfactant is selected from the group consisting of anionic surfactants, nonionic surfactants, cationic surfactants, and combinations thereof, and the surfactant is present in an amount from about 0.01% to about 20% by weight of the resin.

6. The method of claim 1, wherein the rheology modifier is selected from the group consisting of ethylene glycol, propylene glycol, diethylene glycol, triethylene glycol, dipropylene glycol, polyethylene glycol, neopentylene glycol, polypropylene glycol, glycerol, erythritol, threitol, arabitol, xylitol, ribitol, d-mannitol, sorbitol, galactitol, iditol, isomalt, maltitol, lactitol, and combinations thereof.

7. The method of claim 1, wherein the rheology modifier is added to the emulsion in an amount of from about 0.01 pph to about 1 pph.

8. The method of claim 1, wherein the aggregating agent is selected from the group consisting of polyaluminum chloride, polyaluminum bromide, polyaluminum fluoride, polyaluminum iodide, polyaluminum sulfosilicate, aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof.

9. The method of claim 1, wherein the aggregating agent is present in an amount of from about 0.1% to about 8% by weight of the resin in the emulsion.

10. The method of claim 1, wherein the primary slurry has a viscosity of from about 100 cps to about 5000 cps.

11. A method comprising:

contacting at least one amorphous polyester resin in combination with at least one crystalline polyester resin and at least one surfactant to form an emulsion;

contacting the emulsion with an optional wax, an optional colorant, and at least one rheology modifier comprising a polyol, to form a primary slurry;

aggregating the at least one amorphous polyester resin in combination with at least one crystalline polyester resin in the primary slurry with an aggregating agent to form aggregated particles;

coalescing the aggregated particles to form toner particles; and recovering the toner particles, wherein the emulsion has a solids content of from about 5% to about 35% by weight.

12. The method of claim 11, wherein the at least one amorphous polyester resin is of the formula:

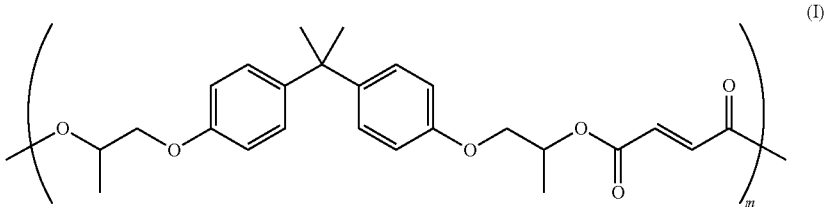

(I)

wherein m is from about 5 to about 1000, and the at least one crystalline polyester resin is of the formula:

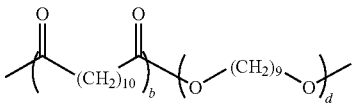

(II)

wherein b is from about 5 to about 2000 and d is from about 5 to about 2000.

13. The method of claim 11, wherein the at least one surfactant is selected from the group consisting of anionic surfactants, nonionic surfactants, cationic surfactants, and combinations thereof, and the surfactant is present in an amount from about 0.01% to about 20% by weight of the resin.

14. The method of claim 11, wherein the rheology modifier is selected from the group consisting of ethylene glycol, propylene glycol, diethylene glycol, triethylene glycol, dipropylene glycol, polyethylene glycol, neopentylene glycol, polypropylene glycol, glycerol, erythritol, threitol, arabitol, xylitol, ribitol, d-mannitol, sorbitol, galactitol, iditol, isomalt, maltitol, lactitol, and combinations thereof.

15. The method of claim 11, wherein the rheology modifier is added to the emulsion in an amount of from about 0.01 pph to about 1 pph.

16. The method of claim 11, wherein the aggregating agent is selected from the group consisting of polyaluminum chloride, polyaluminum bromide, polyaluminum fluoride, polyaluminum iodide, polyaluminum sulfosilicate, aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof.

17. The method of claim 11, wherein the aggregating agent is present in an amount of from about 0.1% to about 8% by weight of the resin in the emulsion.

18. The method of claim 11, wherein the primary slurry has a viscosity of from about 100 cps to about 5000 cps.

19. A method comprising:

contacting at least one amorphous polyester resin in combination with at least one crystalline polyester resin and at least one surfactant to form an emulsion;

contacting the emulsion with an optional wax, an optional colorant, and at least one rheology modifier selected from the group consisting of ethylene glycol, propylene glycol, diethylene glycol, triethylene glycol, dipropylene glycol, polyethylene glycol, neopentylene glycol, polypropylene glycol, glycerol, erythritol, threitol, arabitol, xylitol, ribitol, d-mannitol, sorbitol, galactitol, iditol, isomalt, maltitol, lactitol, and combinations thereof, in an amount of from about 0.01 pph to about 1 ppb to form a primary slurry having a viscosity of from about 100 cps to about 5000 cps;

aggregating the at least one amorphous polyester resin in combination with at least one crystalline polyester resin in the primary slurry with an aggregating agent to form aggregated particles;

coalescing the aggregated particles to form toner particles; and recovering the toner particles, wherein the emulsion has a solids content of from about 5% to about 35% by weight.

20. The method of claim 19, wherein the aggregating agent is selected from the group consisting of polyaluminum chloride, polyaluminum bromide, polyaluminum fluoride, polyaluminum iodide, polyaluminum sulfosilicate, aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof, present in an amount of from about 0.1% to about 8% by weight of the resin in the emulsion.

* * * * *